United States Patent [19]

Kondis

[11] 4,191,557

[45] Mar. 4, 1980

[54] PRODUCTION OF METALLIC POWDERS

[75] Inventor: Thomas J. Kondis, Pittsburgh, Pa.

[73] Assignee: Aluminum Company of America, Pittsburgh, Pa.

[21] Appl. No.: 945,324

[22] Filed: Sep. 25, 1978

Related U.S. Application Data

[63] Continuation-in-part of Ser. No. 781,109, Mar. 25, 1977, abandoned.

[51] Int. Cl.[2] ..... C22B 13/04; C22B 23/04; C22B 25/04; C22B 34/32

[52] U.S. Cl. ..... 75/0.5 A; 75/0.5 AA; 75/0.5 AB; 75/109

[58] Field of Search ..... 75/0.5 R, 0.5 A, 0.5 AA, 75/0.5 AB, 0.5 AC, 109, 119; 204/10, 14 N; 427/123, 217

[56] References Cited

U.S. PATENT DOCUMENTS

| | | | |
|---|---|---|---|
| 860,661 | 7/1907 | Hendryx | 75/109 |
| 2,934,478 | 4/1960 | Schickner | 204/14 N |
| 3,136,621 | 6/1964 | Pearson | 75/0.5 AA |
| 3,165,397 | 1/1965 | Lobo | 75/0.5 A |
| 3,607,675 | 9/1971 | Haines | 204/10 |
| 3,616,280 | 10/1971 | Arnold | 204/14 N |
| 3,697,398 | 10/1972 | Wessling et al. | 204/14 N |
| 3,701,650 | 10/1972 | Zeeuw | 75/0.5 A |
| 3,772,170 | 11/1973 | Bharucha | 204/14 N |
| 3,853,931 | 10/1974 | Kondis | 260/448 A |
| 3,874,940 | 4/1975 | Vera et al. | 75/109 |
| 3,877,932 | 4/1975 | Elges | 75/0.5 A |
| 3,890,166 | 6/1975 | Kondis | 148/6.27 |
| 3,902,896 | 9/1975 | Borbely et al. | 75/109 |
| 4,097,313 | 6/1978 | Tokuoka et al. | 75/0.5 AA |
| 4,119,699 | 10/1978 | Kellerwessel et al. | 423/DIG. 15 |

FOREIGN PATENT DOCUMENTS

| | | | |
|---|---|---|---|
| 523642 | 4/1956 | Canada | 75/109 |
| 837998 | 3/1970 | Canada | 75/0.5 A |
| 694150 | 6/1940 | Fed. Rep. of Germany | 75/0.5 R |
| 1607459 | 9/1969 | Fed. Rep. of Germany | 75/0.5 R |
| 2602849 | 2/1978 | Fed. Rep. of Germany | 423/DIG. 15 |
| 37-16833 | 10/1962 | Japan | 75/0.5 A |
| 41-4566 | 3/1966 | Japan | 75/0.5 A |
| 403469 | 12/1933 | United Kingdom | 75/109 |
| 191811 | 1/1967 | U.S.S.R. | 75/117 |
| 312886 | 8/1971 | U.S.S.R. | 75/0.5 A |
| 490849 | 2/1974 | U.S.S.R. | 75/117 |

OTHER PUBLICATIONS

Langes Handbook of Chemistry, pp. 1244–1249 (1952).

*Primary Examiner*—L. Dewayne Rutledge
*Assistant Examiner*—Michael L. Lewis
*Attorney, Agent, or Firm*—Daniel A. Sullivan, Jr.

[57] ABSTRACT

The process of producing a metallic powder from a metal compound such as nickel chloride comprising the steps of: first forming a slurry of (1) a compatible, non-aqueous liquid in which the metal compound is completely or partially soluble, and (2) a reactive metal which occupies a position in the electromotive series above the position of the metal constituent in the metal compound, i.e. has a single electrode potential more negative than that of the metal constituent in the metal compound. The metal compound is then added to the solvent in the slurry, e.g. forming a slurry of pyrophoric aluminum powder in methyl ethyl ketone (MEK) and then adding nickel chloride to the MEK. The reactive metal can be in a pyrophoric state prior to introduction of the metal compound, or it can be made to be pyrophoric in the presence of the metal compound, so that it reduces the metal constituent of the dissolved metal compound as metal compound solution contacts the pyrophoric metal surface. For example, aluminum powder can be made sufficiently reactive by milling to produce pyrophoric surfaces. Alternatively, if the metal compound is a liquid, e.g. stannic chloride, a part or all of the carrier liquid needed to slurry the potentially pyrophoric reactive metal may be eliminated.

11 Claims, 1 Drawing Figure

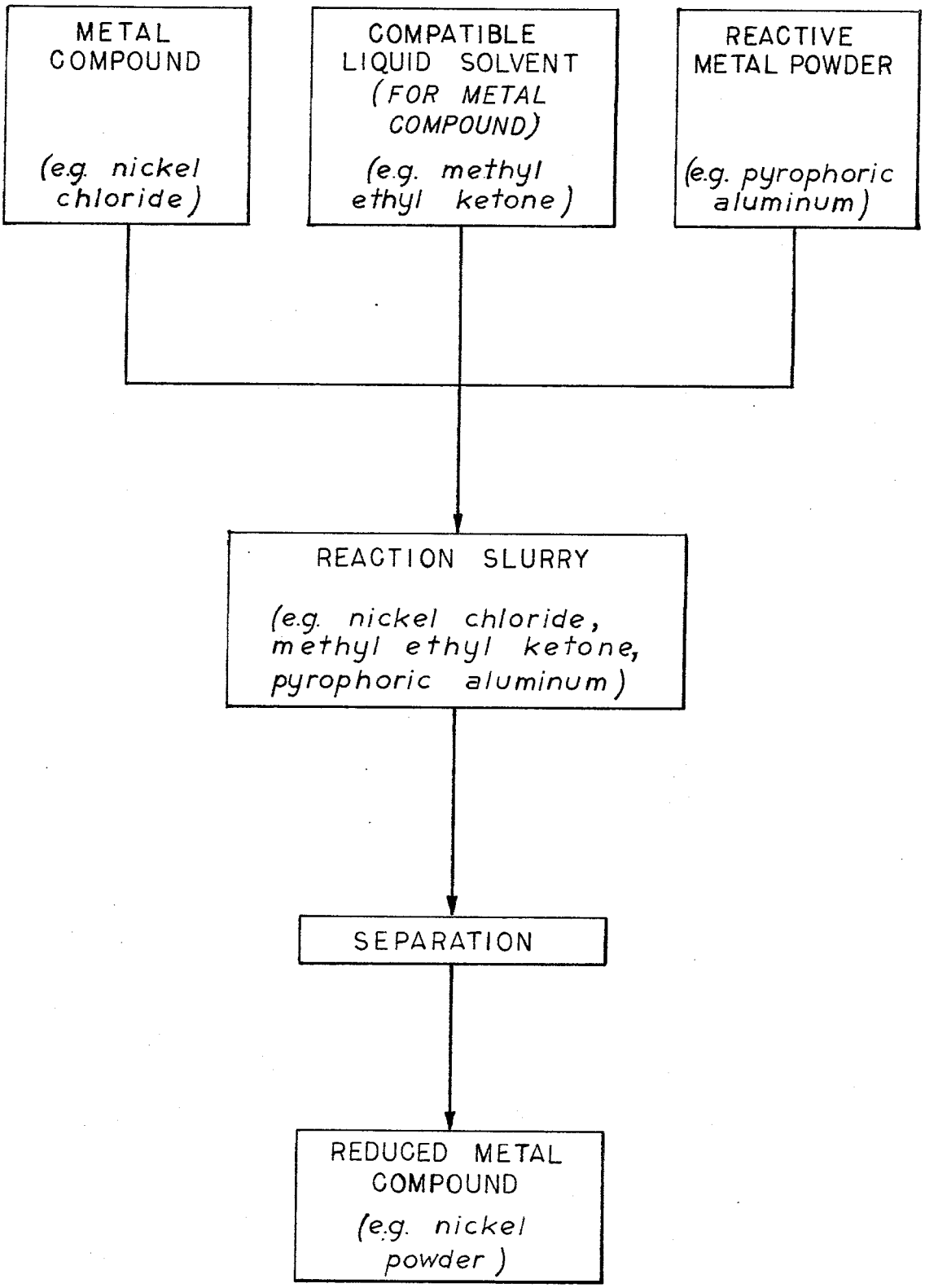
METAL COMPOUND
(e.g. nickel chloride)
COMPATIBLE LIQUID SOLVENT (FOR METAL COMPOUND)
(e.g. methyl ethyl ketone)
REACTIVE METAL POWDER
(e.g. pyrophoric aluminum)
REACTION SLURRY
(e.g. nickel chloride, methyl ethyl ketone, pyrophoric aluminum)
SEPARATION
REDUCED METAL COMPOUND
(e.g. nickel powder)

PRODUCTION OF METALLIC POWDERS

CROSS-REFERENCE TO RELATED APPLICATION

This is a continuation-in-part of my U.S. patent application Ser. No. 781,109, filed Mar. 25, 1977, for "Production of Metallic Powders". Application Ser. No. 781,109 has been subsequently abandoned.

BACKGROUND OF THE INVENTION

This invention relates to the production of metallic powders. More particularly, it relates to a metallic powder and process for producing a metallic powder by reducing a solubilized or liquid metal compound by contacting it with the pyrophoric surface of a reactive metal powder.

Conventionally, various techniques exist for the production of metal powders. These include atomization, grinding, gaseous reduction of oxides, gaseous reduction of solutions, reduction with carbon, carbonyl decomposition and electrolytic methods.

In the case of aluminum, powdered metal may be obtained by atomization or by milling larger particles of aluminum, both methods being well known in the art.

Several pure metals and many alloys are produced commercially in large quantities by aluminothermic reduction, also known as the thermite process. In this process, aluminum is melted in contact with other metal ores, resulting in oxidation of aluminum and reduction of the ore. The reduced metal is usually obtained as an undivided lump assuming the form of the reaction vessel. Aluminothermic reactions require initial high temperatures to melt the aluminum and start the reaction; the reaction itself generates additional heat which is generally sufficient to melt the reduced metal if its melting point is higher than that of aluminum. By means of the techniques described in this invention, such reductions are carried out at temperatures far below that at which aluminum melts and are carried out successfully even at ambient temperature. Quite surprisingly, the reduced metal assumes a powder form, so that this technique represents a novel alternate method for producing metal powders.

It is known from my previous U.S. Pat. No. 3,890,166 that the milling of aluminum produces pyrophoric surfaces capable of reacting with other compounds. My previous U.S. Pat. No. 3,853,931 describes the manufacture of aluminum hydrocarbyls by adding hydrogen and an olefin or aluminum hydrocarbyl compound to an autoclave containing an activated slurry of pyrophoric aluminum powder in benzene.

SUMMARY OF THE INVENTION

An object of this invention is the production of metallic powders at ambient temperature by reaction between a pyrophoric reactive metal and a metal compound.

Another object of this invention is the production of metallic powders directly from a metal salt or a metal oxide.

Further objects of this invention will become apparent from the drawing, description and claims appended hereto.

In accordance with these objects, there is provided a method of reducing a metal compound to a metallic powder. A slurry is formed of (1) a compatible, nonaqueous liquid in which the metal compound is completely or partially soluble and (2) a reactive metal which occupies a position in the electromotive series above the position of the metal constituent in the metal compound. The metal compound, if not normally in the liquid state, is then dissolved into the solvent in the slurry. The reactive metal is either initially pyrophoric or is made to be pyrophoric in the presence of the metal compound so that it reduces the metal constituent of the metal compound upon contact between the metal compound solution and the reactive metal. The reduced metal appears as a finely divided solid which is then recovered from the resultant slurry.

In a preferred embodiment of the invention, the metal compound is a metal halide, and the reactive metal is pyrophoric aluminum powder.

BRIEF DESCRIPTION OF THE DRAWING

The sole drawing is a flowsheet illustrating the process of the invention.

DETAILED DESCRIPTION OF THE PREFERRED EMBODIMENTS

In accordance with the present invention, a metallic powder is prepared from a metal compound. The metal compound is contacted with a pyrophoric reactive metal which is thermodynamically capable of reducing the metal compound.

The metal constituent of the metal compound is any metal below the reactive metal in the electromotive series. For example, when aluminum is the reactive metal, the metal constituent of the metal compound is selected from the group consisting of nickel, cobalt, iron, tin, manganese, zinc chromium and silver. All of these metals are below aluminum in the electromotive series. The use of the term "metal compound" herein is intended to include both organic and inorganic compounds of a metal and includes both ionically and covalently bonded species. Organometallic compounds of the metals may also be employed such as soaps, i.e. naphthenates. The anion constituent of metallic inorganic compounds may be any ion such as a nitrate, sulfate, halide or oxide capable of dissolving in an appropriate solvent, as will be discussed below. Halides are preferred, and chlorides are particularly preferred because of their generally good solubility in organic liquids, ready commercial availability and relatively low costs.

The reactive metal is preferably in the form of a pyrophoric metal powder. Aluminum powder is particularly preferred. By "aluminum", I mean aluminum and aluminum base alloys containing at least 50% by weight aluminum. *The Condensed Chemical Dictionary,* 8th Edition (1971) defines pyrophoric as "descriptive of any substance that ignites spontaneously in air". By "pyrophoric metal powder", I mean a reactive metal powder having nascent surfaces of the metal unprotected against further chemical reaction. For example, pyrophoric aluminum powder may be produced by milling as described in my previous U.S. Pat. No. 3,890,166, wherein the surface area of the aluminum is increased without increasing the oxide content, thereby leaving the nascent aluminum surface unprotected by its normal barrier oxide layer against further chemical reaction of the underlying metal. Other reactive metals include lithium, sodium, potassium, rubidium, cesium, beryllium, magnesium, calcium, strontium, barium and lanthanum. The reactive metal must occupy a position in the electromotive series above the position of the metal constituent in the metal compound, i.e. has a single electrode potential more negative than that of the metal constituent in the metal compound. See, for example, the "Table of Single Electrode Potentials at 25° C." and the "Electromotive Series of the Metals Table" as both shown in *Lange's Handbook of Chemistry,* 1952, on pages 1244–1249.

I will refer to metal powders which have not yet been milled so as to create nascent reactive surfaces thereon as "potentially pyrophoric reactive metal powders". This includes atomized, granulated and other particulate metal powders which may be "activated" so as to contain pyrophoric reactive surfaces via milling.

The pyrophoric aluminum powder may be produced according to the method described in my previous U.S. Pat. No. 3,890,166. I mill particulate aluminum in the presence of a material (which I will call a milling aid) that will sorb onto the surface of the aluminum sufficiently to stabilize it against rewelding in the mill but insufficiently to prevent access to the nascent aluminum surface by a more reactive substance, thereby imparting to aluminum a high degree of activity, particularly chemical reactivity. Highly sorptive oxygen-containing compounds of limited reactivity have been found to be most efficient in preparing active aluminum. By "highly sorptive", I mean having the capability of being easily or readily sorbed onto the surface of the aluminum particles. By "of limited reactivity", I mean of insufficient reactivity to react to produce an undesirable new compound in bulk during the milling. The milling aid must be so constructed or made up that it sorbs onto the surface of the particulate aluminum during milling just enough to protect it adequately in the mill, that is, just enough to promote comminution rather than welding of particles, but can be displaced by another material or otherwise allow access to the nascent aluminum after completion of the milling.

Preferred compounds coming within this category include ketones, aldehydes, amides, carboxylic acids, peroxides, epoxies, ethers (such as i-propyl ether), esters, organic phosphates, organic nitrates, organic sulfonates, silicones and anhydrides. Olefins, hydrocarbon free radicals, hydrazine free radicals and chlorinated hydrocarbons (including carbon tetrachloride) are also representative of materials which have the required sorptive power, that is, power to be sorbed on the surface of the aluminum for producing the desired activity in milled aluminum. Alcohols, when inhibited sufficiently to prevent reaction in bulk with the aluminum may also be used.

The particulate aluminum that may be activated in the presence of milling aids, such as identified hereinabove, include atomized aluminum, granulated aluminum, powdered aluminum, aluminum powder, or any other type of aluminum particles fine enough to be milled, for example, in a rotating ball mill or vibratory mill. The particle size is not critical according to the invention. Nor is the temperature during milling critical, ambient temperature being satisfactory.

The liquid selected for dissolving the metal compound, hereinafter called a "compatible, non-aqueous liquid solvent" must be one in which the metal compound is at least partially soluble. The solvent is chosen so as to minimize competing side reactions between the solvent and the pyrophoric reactive metal surfaces. Any reaction which occurs between solvent and pyrophoric reactive metal must not progress beyond self-limiting surface reactions. The solvent must also easily wet the reactive surfaces of the reactive metal powder. For example, metal halides are generally soluble in organic liquids, especially in ketones, which easily wet the reactive surfaces of pyrophoric aluminum powder. Water and other hydroxylated solvents (e.g. methanol, ethanol, etc.) are undesirable choices as they react "in bulk" with the pyrophoric reactive metal (e.g. pyrophoric aluminum powder) and result in the formation of metal oxides, hydroxides or alkoxides which are deleterious to the desired product purity and yield. By reaction "in bulk", I mean a reaction with the entire metal particle, not merely a self-limiting type surface reaction. For example, Boehmite (alpha alumina monohydrate) formed on the surface of a pyrophoric aluminum particle will not stop water from further penetrating and reacting completely (i.e. "in bulk") with the underlying metal. The reactivity of the pyrophoric powder is such that particle size tends to be immaterial in that pyrophoric powder reacts in toto with an aqueous or hydroxylated solvent.

In my previous U.S. Pat. No. 3,890,166, column 3, lines 3–19, I indicated that pyrophoric aluminum reacted immediately when immersed in distilled water as was visually observed in the generation of hydrogen bubbles at the surface. Immediate reaction also occurred in 0.7 N nitric acid, beginning immediately upon contact. Powder milled in the absence of MEK required several hours for initiation of reaction in 0.7 N nitric acid, and even then was rather difficult to detect, only a few bubbles of hydrogen being evolved. The use of an organic liquid such as methyl ethyl ketone (MEK) allows the metal compound to be presented intimately to the reactive aluminum surface for reaction under conditions which minimize side reactions. Other useful solvents include aldehydes, for example, propionaldehyde; esters, for example, ethyl acetate; and ethers, for example, tetrahydrofuran and diethyl ether.

In one embodiment the reactive metal powder is milled in the compatible liquid solvent to produce the pyrophoric surfaces, and then the metal compound is added to the slurry of pyrophoric metal powder and liquid solvent in the form of a liquid where the metal compound is dissolved in a solvent (if it is not normally in liquid form) or as a solid which dissolves into the solvent in the slurry.

The slurry of pyrophoric metal powder and the liquid containing the dissolved metal compound may be subjected to a temperature ranging from ambient conditions to the boiling point of the solvent to better aid dissolution of the metal compound in the solvent, for example, when the metal compound is added as a solid, and to speed the reduction process by maintaining the metal compound in a saturated solution.

In the preferred embodiment of the invention, a dissolved metal compound, such as identified hereinabove, is contacted with the pyrophoric surfaces of the reactive metal powder during the milling operation as the pyrophoric surfaces are being generated. In any of the above procedures for reducing the metal compound by bringing it in contact with the pyrophoric reactive metal, the reduced metal appears as a finely divided solid which is then subsequently separated from the resultant slurry.

The following examples are still further illustrative of the invention.

EXAMPLE 1

7.0 g atomized aluminum powder were vibratory milled for two hours in 150 ml methyl ethyl ketone. The resultant pyrophoric aluminum powder slurry was transferred under $N_2$ to a one liter capacity, three-neck reaction flask fitted with a stirrer and condenser. While stirring, 48 g anhydrous $NiCl_2$ were added to the slurry.

The slurry was heated to reflux at 80° C. for three hours, then was allowed to cool to room temperature and set overnight unstirred. 100 ml #30 alcohol were added to deactivate any pyrophoric aluminum that might remain in the slurry, and the slurry was filtered through Whatman #1 filter paper. The filtered solids were washed thoroughly with water then with methanol. The product powder was slurried in one Normal sodium hydroxide solution to remove any residual aluminum, aluminum oxide or aluminum oxychloride. After filtering and washing with water and methanol, 8.7 g powder were recovered. The product was identified as metallic nickel by x-ray powder diffraction.

EXAMPLE 2

5.4 g atomized aluminum powder and 39 g anhydrous $NiCl_2$ were vibratory milled for two hours in 200 ml methyl ethyl ketone. After milling, the powder solids were allowed to settle, and the supernatant liquid was decanted off. The residual powder was treated with one Normal sodium hydroxide solution and was subsequently filtered and washed. The product powder was identified as nickel by emission spectroscopic analysis.

EXAMPLE 3

5.4 g atomized aluminum powder and 57 g $SnCl_2$ were vibratory milled for two hours in 200 ml methyl ethyl ketone. The slurry was filtered, then was washed successively with methyl ethyl ketone, water and acetone. The residual powder was slurried in one Normal sodium hydroxide solution, filtered and washed. The shiny product powder was identified as tin by emission spectroscopic analysis.

EXAMPLE 4

2.0 g atomized aluminum powder and 15.0 g anhydrous $CoCl_2$ were vibratory milled for one hour in 150 ml methyl ethyl ketone. The slurry was filtered, then was washed successively with methyl ethyl ketone, water and acetone. The residual powder was slurried in one Normal sodium hydroxide solution, filtered and washed. The dried product powder was identified as metallic cobalt by x-ray powder diffraction.

EXAMPLE 5

35.0 g atomized aluminum powder were vibratory milled two hours with two ml methyl ethyl ketone in 173 ml tetrahydrofuran. The resultant pyrophoric aluminum slurry was transferred under $N_2$ with an additional 150 ml tetrahydrofuran to a one liter capacity, three-neck reaction flask fitted with a stirrer and $N_2$ bubbler. A total of 55 g $AgNO_3$ was added to the flask while stirring. Following this addition, a total of 100 ml water was added slowly in increments. This addition of water generated heat. After cooling, the slurry was filtered through S&S No. 589 filter paper and was washed with water until an HCl test of the washings was negative for $Ag^+$ ion. The residual powder was slurried in one Normal sodium hydroxide, filtered and washed. The dried powder product was identified as metallic silver by x-ray powder diffraction. This analytical technique also identified the presence of a very small quantity of alpha alumina monohydrate. It is postulated that, in order to escape attack and dissolution by the caustic treatment, the alumina is encapsulated by the metallic silver and had thus been prevented from contacting the caustic solution. The presence of alumina also verifies that the pyrophoric aluminum powder also reacted with water in competition with the Ag(I)-Ag(O) reduction. Also, the invention examples analyses demonstrate the capability for cleaning residual aluminum and aluminum compounds from the metal product.

Having thus described the invention and certain embodiments thereof, I claim:

1. The process of producing a metallic powder by reducing a metal compound comprising the steps of:
   (a) milling a slurry of (1) a compatible, non-aqueous liquid solvent, which has said metal compound dissolved therein to thereby form a solution and (2) a reactive metal powder which occupies a position in the electromotive series of elements above the position of the metal constituent in said metal compound, i.e. has a single electrode potential more negative than that of the metal constituent in said metal compound, said reactive metal powder being sufficiently reactive to reduce the metal constituent in said metal compound upon contact during the milling of said slurry as said reactive metal is made active by the milling, competing side reactions between the solvent and the active metal surfaces generated during the milling not progressing beyond self-limiting surface reactions, whereby the reduced metal appears as a finely divided solid, said reactive metal being aluminum, the finely divided reduced metal solid being characterized by an ability to be cleaned of residual aluminum or aluminum compounds; and
   (b) recovering the reduced metal from the resultant slurry.

2. The process of claim 1 wherein the metal compound is selected from the group consisting of metal halides and metal nitrates.

3. The process of claim 2 wherein the metal halide is a metal chloride.

4. The process of claim 1 wherein the metal constituent of said metal compound is selected from the group consisting of nickel, cobalt, iron, tin, manganese, zinc, chromium and silver.

5. The process of claim 1 wherein the compatible, non-aqueous liquid solvent is an organic liquid.

6. The process of claim 1 wherein the non-aqueous, compatible liquid solvent is methyl ethyl ketone.

7. The process of producing a metallic powder by reducing a metal compound comprising the steps of:
   (a) forming a slurry or (1) a compatible, non-aqueous liquid solvent in which the metal compound is completely or partially soluble, and (2) a pyrophoric reactive metal which occupies a position in the electromotive series of elements above the position of the metal constituent in said metal compound, i.e. has a single electrode potential more negative than that of the metal constituent in said metal compound;
   (b) dissolving said metal compound into the compatible liquid solvent in said slurry so as to thereby form a solution and to bring said pyrophoric reactive metal into contact with the dissolved metal compound, said pyrophoric reactive metal being sufficiently reactive to reduce the metal constituent in said metal compound upon contact between said solution and said pyrophoric reactive metal and where competing side reactions between the solvent and the pyrophoric reactive metal do not progress beyond self-limiting surface reactions, whereby the reduced metal appears as a finely divided solid, said reactive metal being aluminum, the finely divided reduced metal solid being characterized by an ability to be cleaned of residual aluminum or aluminum compounds; and (c) recovering the reduced metal from the resultant slurry.

8. The process of claim 7 wherein the slurry of pyrophoric reactive metal powder and the compatitble, non-aqueous liquid solvent containing the dissolved metal compound is subjected to a temperature ranging from ambient conditions to the boiling point of the solvent.

9. The process of claim 7 wherein the pyrophoric reactive metal is in powder form and is brought into contact with said metal compound subsequent to milling.

10. The process of claim 7 wherein the metal compound is added to said slurry of pyrophoric reactive metal and compatible, non-aqueous liquid solvent in the form of a solution where said metal compound is dissolved in a solvent if it is not already in liquid form.

11. The process of claim 7 wherein the metal compound is added to said slurry of pyrophoric reactive metal and compatible, non-aqueous liquid solvent in the form of a solid which dissolves into the solvent in the slurry.

* * * * *

UNITED STATES PATENT AND TRADEMARK OFFICE

CERTIFICATE OF CORRECTION

PATENT NO. : 4,191,557

DATED : March 4, 1980

INVENTOR(S) : Thomas J. Kondis

It is certified that error appears in the above-identified patent and that said Letters Patent are hereby corrected as shown below:

Under "References Cited - Foreign Patent Documents", change "Fed. Rep. of Germany 1,607,459" to --Fed. Rep. of Germany 1,607,454--.

Col. 2, line 34 Change "zinc chromium" to --zinc, chromium-

Claim 7, line 3 After "slurry", change "or" to --of--.

Signed and Sealed this

*Seventeenth* Day of *June 1980*

[SEAL]

*Attest:*

SIDNEY A. DIAMOND

*Attesting Officer* *Commissioner of Patents and Trademarks*